US008100072B2

(12) United States Patent
Wilkinson et al.

(10) Patent No.: US 8,100,072 B2
(45) Date of Patent: Jan. 24, 2012

(54) FABRIC SAIL

(76) Inventors: Keith Wilkinson, Stirling (GB); Paul Stuart Baglin, Stirling (GB)

( * ) Notice: Subject to any disclaimer, the term of this patent is extended or adjusted under 35 U.S.C. 154(b) by 466 days.

(21) Appl. No.: 12/227,352

(22) PCT Filed: Apr. 27, 2007

(86) PCT No.: PCT/GB2007/001500

§ 371 (c)(1),
(2), (4) Date: Nov. 14, 2008

(87) PCT Pub. No.: WO2007/132147

PCT Pub. Date: Nov. 22, 2007

(65) Prior Publication Data

US 2010/0203297 A1 Aug. 12, 2010

(30) Foreign Application Priority Data

May 15, 2006 (GB) ..... 0609583.0

(51) Int. Cl.
*B63H 9/04* (2006.01)

(52) U.S. Cl. ..... 114/102.1; 52/80.2

(58) Field of Classification Search ..... 114/102.1, 114/104, 105, 108, 102.11, 102.15; 52/80.1, 52/80.2, 81.1, 81.2; 135/25.31, 98; 428/174, 428/193

See application file for complete search history.

(56) References Cited

U.S. PATENT DOCUMENTS

| | | | | |
|---|---|---|---|---|
| 3,252,469 | A * | 5/1966 | Peake | 135/25.31 |
| 3,310,018 | A * | 3/1967 | Roberts, Jr. et al. | 114/104 |
| 4,688,506 | A * | 8/1987 | van Breems | 114/104 |
| 4,864,952 | A * | 9/1989 | Stevenson, IV | 114/102.1 |
| 5,048,443 | A * | 9/1991 | Brown | 114/104 |
| 5,787,831 | A * | 8/1998 | von Schwarzenfeld | 114/104 |
| 6,807,919 | B1 * | 10/2004 | Thomsen | 114/102.11 |

FOREIGN PATENT DOCUMENTS

WO 9519483 A1 7/1995

* cited by examiner

*Primary Examiner* — Lars A Olson

(74) *Attorney, Agent, or Firm* — Hulquist, PLLC; David Bradin

(57) ABSTRACT

The present invention relates to a fabric sail (1) which maintains a minimal surface. An elastic boundary is attached to the edges of an elastic membrane, and the edges (4) are shaped so that the membrane of the sail maintains a minimal surface configuration despite being deformed by the boundary. The sail therefore distributes strain across the sail surface and is thus free of wrinkles and creases. Points on the elastic membrane itself can be displaced but still form a minimal surface as defined by the boundary and the displaced surface connection points. In addition, strain matching allows the boundary and the elastic membrane to optimally share the strain caused by any deformation.

17 Claims, 1 Drawing Sheet

FABRIC SAIL

The present invention relates to a fabric sail, and in particular a deformable fabric sail which maintains a minimal surface.

Fabric sails are used in a variety of locations, for example bars, restaurants, hotels and shopping centres where they can be presented as sculptural elements or used in a functional way to provide shade or a partition.

Conventional sails are constructed from a single piece of fabric, or from a number of interconnected panels of fabric if a three dimensional shape is required. These sails have a stiff edge condition such as steel cable, nylon cord or polyester webbing. The problem with this approach is that a new sail has to be designed for each new location where a sail is to be deployed. Additionally, if the sail does not fit an entire new sail must be made.

An alternative sail is constructed from a single piece of fabric, with no edge condition at all. These kinds of sails are very flexible but due to the lack of an edge condition the sail surface can suffer a loss of tension when deformed, and the edges of the fabric itself are prone to sagging.

Said conventional sails are capable of forming a minimum surface in equilibrium, if designed to do so. However, deformation of such sails will result in a non-minimal surface being formed. Some examples of a non-minimal surface include surfaces with folds, wrinkles and creases as well as sagging—which are generally the result of deforming the conventional sails discussed above.

A minimal surface is defined as a surface having a mean curvature of zero. A minimal surface usually, for a given boundary, cannot be changed without increasing the area of the surface, i.e. it is the minimum surface area within a given boundary.

By way of example, it is known to construct sails from a rectangular piece of cloth, and to provide a rigid boundary, such as a steel cable, to shape the sail. Deformation of the sail is limited due to the stiffness of the cable. Fixing three of the corners and attempting to stretch the sail by pulling the remaining corner will result in overloading and unloading of the surface area outwith the strain limit, and will most likely cause wrinkles to appear. Furthermore, attaching only two of the corners and pulling the remaining two corners out of the plane will result in only a small (if any) expansion of the surface area and likely substantial wrinkling as the fabric is subjected to uneven strains.

It is therefore an object of the present invention to provide a fabric sail that obviates and mitigates one or more of the disadvantages and limitations of the prior art.

According to a first aspect of the present invention, there is provided a sail comprising an elastic membrane having at least three perimeter edges and an elastic boundary attached to the perimeter edges wherein the at least three perimeter edges are shaped such that deformation of the elastic boundary translates the elastic membrane between a first minimal surface configuration and a second minimal surface configuration.

By moving between a first minimal surface configuration and a second minimal surface configuration, the membrane of the sail maintains a minimal surface configuration despite being deformed by the boundary. The sail therefore distributes strain across the sail surface and is thus free of wrinkles and creases.

Preferably, the elastic membrane comprises a material having an elastic strain limit greater than 10%.

Optionally, the elastic membrane comprises a material having an elastic strain limit less than 200%.

Preferably, the elastic boundary comprises a material having an elastic strain limit greater than 10%.

Optionally, the elastic boundary comprises a material having an elastic strain limit less than 200%.

Most preferably, the elastic boundary comprises a material having an elastic strain limit substantially the same as that of the elastic membrane.

Optionally, the elastic membrane comprises a material having a Young's modulus less than 10 MPa.

Optionally, the elastic membrane comprises a material having a Young's modulus less than 2 MPa.

Optionally, the elastic boundary comprises a material having a Young's modulus less than 10 MPa.

Optionally, the elastic boundary comprises a material having a Young's modulus less than about 2 MPa.

Optionally, the elastic boundary comprises a material having a Young's modulus greater than that of the elastic membrane.

Preferably, the elastic membrane forms an anticlastic surface when the elastic boundary is deformed out of a plane of the elastic membrane.

Preferably, the elastic boundary is deformable by displacing one or more connection points.

Preferably, the elastic boundary is adapted to provide connection points at the apexes formed by adjacent perimeter edges.

Optionally, the elastic boundary is further adapted to provide connection points along the perimeter edges.

Optionally, the elastic boundary is adapted to provide connection points for connecting to an external frame.

Optionally, the elastic membrane is adapted to provide surface connection points on a surface thereof.

Most preferably, the elastic membrane is deformable by displacing the surface connection points.

Most preferably, displacing the surface connection points translates the elastic membrane between a first minimal surface configuration and a second minimal surface configuration.

In this way, points on the elastic membrane itself can be displaced but still form a minimal surface as defined by the boundary and the displaced surface connection points.

Optionally, the connection points further comprise leader lines attached thereto for connecting to the external frame.

Preferably, the at least three perimeter edges are shaped so as to optimise the ability of the membrane to form a minimal surface.

Preferably, the at least three perimeter edges are substantially arcuate.

Alternatively, the at least three perimeter edges are hyperbolic.

Alternatively, the at least three perimeter edges are parabolic.

Optionally, the perimeter edges are shaped so as to strain match the boundary with the elastic membrane.

Strain matching allows the boundary and the elastic membrane to optimally share the strain caused by any deformation, and thus remain in a minimal surface configuration.

Preferably, the at least three edges are shaped so as to optimise the transfer of a load from the elastic boundary to the elastic membrane.

Preferably, the elastic membrane comprises a flame retardant material.

Preferably, the elastic membrane comprises Avora®.

Preferably, the elastic boundary comprises an elastic cord.

Preferably, the elastic cord is moveably located along the at least three perimeter edges.

Optionally, the elastic cord is fixedly attached at the apexes of the at least three edges.

Optionally, the elastic cord is attached to the perimeter.

Alternatively, the elastic boundary comprises a silicon rubber compound.

The present invention will now be described by way of example only and with reference to the accompanying figures in which.

When compared with the sails of the prior art, namely fabric sails of fixed sizes defined by rigid or flexible (but not elastic) edge conditions, the present invention enjoys a number of significant advantages as will become apparent in the following descriptions.

Figure 1:
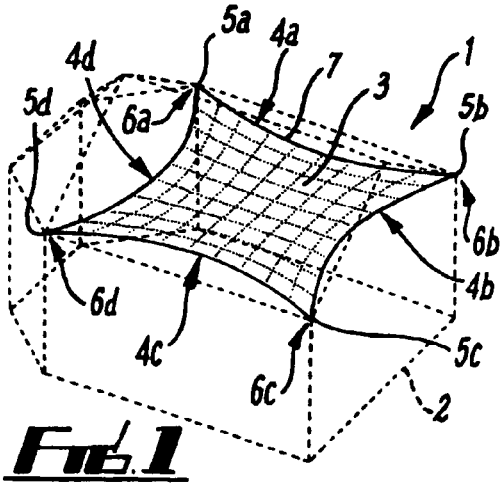
FIG. 1 illustrates in schematic form a fabric sail in accordance with an aspect of the present invention.

With reference to FIG. 1, there is presented a fabric sail 1 which is disposed within a structure 2 as described in detail below. The fabric sail 1 comprises a sail surface 3 with four edges 4*a*,4*b*,4*c*,4*d* defining the perimeter of the sail 1. A fixing point at each of the corners 5*a*,5*b*,5*c*,5*d* is connected to corresponding fixings 6*a*,6*b*,6*c*,6*d* on the structure 2.

The sail surface is highly elastic and comprises a material such as Avora®, which has the added benefit of being highly fire retardant.

In this position, where each of the corners 5 are located in the same plane, the surface 2 of the fabric sail 1 will form a minimal surface in the plane. The perimeter of the sail 1 is bounded by an elastic cord 7, which has a higher Young's modulus (i.e. is stiffer) than the sail surface 3. Furthermore, the edges 4 are curved such that the ability of the surface 3 to form a minimal surface is optimised. The elastic cord 7 spreads the load across the edges 4.

The elastic cord 7 may be held in place by stitching directly onto the edges 4, or by folding the edges 4 over the elastic cord 7 and stitching onto itself such that the elastic cord 7 is retained but is free to move and thus distribute the load around the edges 4 more evenly. Optional tacking at the corners 5 can prevent slippage of the elastic cord 7.

A four sided sail according to the prior art (e.g. fabric with a steel cable forming a rigid but flexible boundary) but shaped to correspond with that of FIG. 1 would indeed exhibit a minimal surface as herein defined. However, if the sail was to be disposed within a different structure or fixed in different locations (see FIG. 2) then an entirely new sail would need to be constructed.

Figure 2:
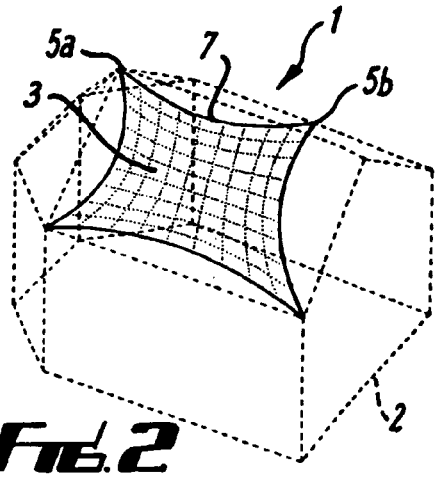
FIG. 2 illustrates in schematic form the fabric sail of FIG. 1, with two of the connection points displaced.

FIG. 2 illustrates the case where the sail 1 of FIG. 1 has two of the corners, 5*a* and 5*b*, displaced. Corner 5*a* has been moved upwards out of the plane of the remaining three corners, and corner 5*b* is displaced within the plane but towards the original position of corner 5*a*. In this configuration, the surface 3 maintains a minimal surface by forming an anticlastic surface due to the vertical displacement of corner 5*a*. Furthermore, the minimal surface is maintained despite the displacement of corner 5*b* due to the elasticity of the surface 3.

A four sided sail according to the prior art but shaped to correspond with that of FIG. 1 would not be able to maintain a minimum surface in this way. One reason for this is because the rigid (but flexible) cable is not capable of stretching and therefore is limited to movement within a restricted range. The elasticity of the boundary of the present invention allows the corners to be displaced within a much larger range of positions. Furthermore, displacing one of the corners would not form an anticlastic surface as the present invention would. The present invention allows stretching across the whole face of the material and along the whole length of the boundary and hence the sail can deform to optimally distribute strain throughout the sail.

Figure 3:
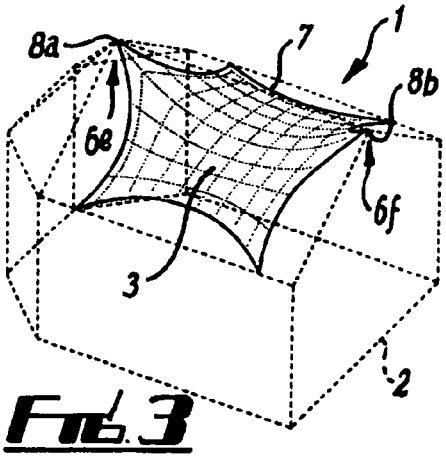
FIG. 3 illustrates in schematic form the fabric sail of FIG. 1, with two additional intermediate connection points to further deform the boundary.

FIG. 3 illustrates the case where the sail 1 of FIG. 1 has two attachment points 8*a*,8*b* attached to opposite edges 4*b*,4*d* to allow further deformation of the sail 1. The attachment points 8*a*,8*b* are also attached to corresponding fixings 6*e*,6*f* on the structure, so as to deform the sail 1 into a shape having 6 edges. Again, the elasticity of the sail surface 3 and of the elastic cord 7 maintains a minimal surface despite the change in configuration.

A four sided sail according to the prior art but shaped to correspond with that of FIG. 1 would not be capable of such deformation. Placing a connection point at the centre of the rigid, but flexible, cable of the prior art sail discussed and displacing the connection point as in FIG. 3 would not have the same effect. In fact, the fixed boundary would allow some limited movement of the boundary, but would tend towards a straight edge rather than forming two additional edges each also having a parabolic or hyperbolic curve which serve to optimise the distribution of strain.

Figure 4:
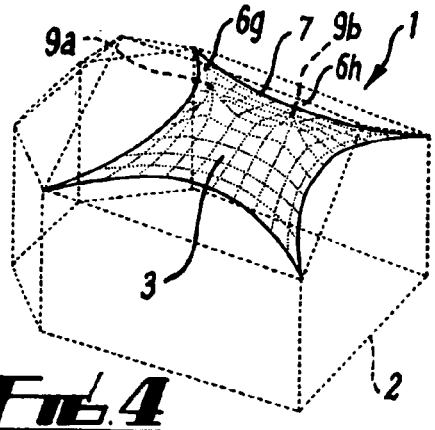
FIG. 4 illustrates in schematic form the fabric sail of FIG. 1, with two surface connection points to deform the sail surface.

In FIG. 4, the sail 1 of FIG. 1 has two surface attachment points 9*a*,9*b* located on the sail surface 3. These attachment points 9*a*,9*b* comprise loops which may be affixed to further fixings 6*g*,6*h* on the structure 2. Once again the sail surface 3 forms a minimal surface regardless of the deformation to the surface 3 itself.

In an alternative embodiment, the attachment points 9*a*,9*b* may be replaced with clips which can temporarily connect to one set of fixings but be easily relocated to other points on the surface suitable for connecting to another set of fixings.

In another alternative embodiment, a cable attached to a fixing on the structure has a magnet at the other end. By placing a metallic disk (or other substantially magnetically susceptible object) on the opposing side of the sail, the magnet may attract and retain the metallic disk and thereby secure the sail therebetween.

A four sided sail according to the prior art but shaped to correspond with that of FIG. 1 would not be able to be deformed as shown in FIG. 4. The sail of the present invention has an elastic boundary which may stretch in conjunction with the surface in order to optimise the distribution of strain within the sail. The prior art sail would not allow deformation in this way as the boundary is fixed and such displacement might cause the sail itself to tear.

Figure 5:
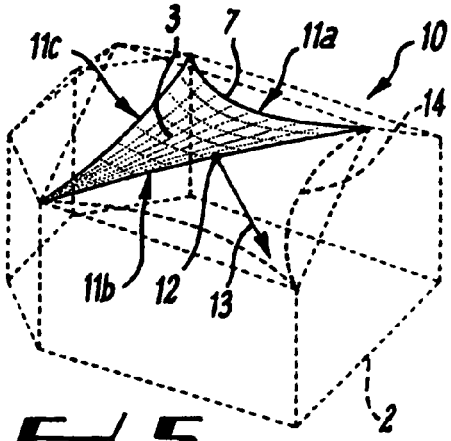
FIG. 5 illustrates in schematic form an alternative fabric sail having three edges.

FIG. 5 illustrates in schematic form an alternative fabric sail 10 to that of FIGS. 1-4 above, in this embodiment having three edges 11*a*,11*b*,11*c*. However, as is the case with the embodiments of FIGS. 1-4, a further attachment (not shown) located at reference numeral 12 and drawn in the direction of arrow 13 will result in a sail with four edges, as indicated by dotted line 14. Again, this will form a minimal surface.

A three sided sail according to the prior art but shaped to correspond with that of FIG. 5 would not be able to be deformed as shown. As the edge corresponding to the stretched edge of FIG. 5 is rigid, regardless of its flexibility it is not possible to deform the shape by stretching the sail outwards in this way. Therefore a three sided sail of the prior art is fixed in size and cannot be expanded.

Figure 6:
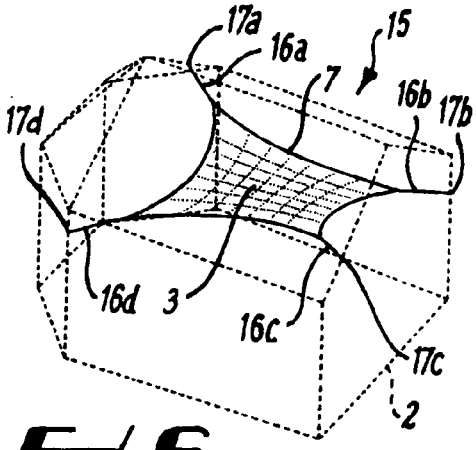
FIG. 6 illustrates in schematic form a further alternative fabric sail that comprises leader lines connected to the connection points to provide an attachment to a structure.

FIG. 6 illustrates an embodiment of the present invention in which a sail 15 is: connected to a structure 2 by means of leader lines 16*a*,16*b*,16*c*,16*d* which are attached to corners 17*a*,17*b*,17*c*,17*d*. The leader lines 16 allow the sail 15 to be located in a structure 2 which is perhaps too large for the sail 15 to be stretched, to accommodate.

Similar leaders may also be attached to surface attachment points 9 which are discussed in relation to FIG. 4 above.

Each of the Figures above illustrate a fabric sail 1,10,15 which forms a minimal surface even when deformed to attach to a structure. It is envisaged that this structure may be an existing structure or a structure purpose built to locate the fabric sail 1 on or in.

In each case, the ability of the boundary to stretch along with the membrane itself is key to maintaining a minimal surface when the sail is deformed. This minimal surface is maintained by the ability of the boundary and the surface to deform together and optimally distribute strain such that there are no wrinkles or creases present. With a fixed boundary and no thought given to the shape of the sail, it is impossible to achieve the wide range of configurations possible with a single sail in accordance with the present invention, let alone without destroying the minimal surface.

The minimal surface is beneficial as strain is relatively uniformly distributed throughout the sail, and is also wrinkle, free and therefore suitable for projecting images onto, as well as being aesthetically pleasing. Other applications will be as sun shields or blinds in conservatories, the flexibility of the present invention allowing one sail to be used for a variety of different sized conservatories. The sail of the present invention is also suitable for use as a partition or as a sculptural feature. One further application will be in large glass shopping malls where the present invention can be used as a sun shield, as a feature to break up large areas of open space, and to collect heat which would otherwise be lost.

Further modifications and improvements may be added without departing from the scope of the invention as defined by the appended claims. For example, where the fabric sail has been described as comprising Avora®, it may alternatively comprise any suitably elastic material. Furthermore, it is envisaged that the elastic cord disclosed in the description could be replaced with a silicon rubber compound.

The invention claimed is:

1. A sail comprising:

an elastic membrane having at least three perimeter edges, wherein an apex is formed by adjacent perimeter edges;

at least one connection point at each apex; and an elastic boundary attached to the perimeter edges;

wherein displacement of one or more connection points is operable to deform the elastic boundary, wherein the deformation of the elastic boundary translates the elastic membrane between a first minimal surface configuration and a second minimal surface configuration, wherein the term minimal surface is defined as a surface having a mean curvature of zero, and wherein the elastic membrane forms an anticlastic surface when the elastic boundary is deformed out of a plane of the elastic membrane.

2. A sail as claimed. in claim 1 wherein, the elastic membrane comprises a material having an elastic strain limit greater than 10%.

3. A sail as claimed in claim. 1 wherein, the elastic membrane comprises a material having an elastic strain limit less than 200%.

4. A sail as claimed in claim 1 wherein, the elastic boundary comprises a material having an elastic strain limit greater than 10%.

5. A sail as claimed in claim l wherein, the elastic boundary comprises a material having an elastic strain limit less than 200%.

6. A sail as claimed in claim 1 wherein, the elastic boundary comprises a material having an elastic strain limit substantially the same as that of the elastic membrane.

7. A sail as claimed claiml wherein, the elastic membrane comprises a material having a Young's modulus less than 2 MPa.

8. A sail as claimed claim wherein, the elastic boundary comprises a material having a Young's modulus less than 10 MPa.

9. A sail as claimed in claim 1 wherein, the elastic boundary comprises a material having a Young's modulus greater than that of the elastic membrane.

10. A sail as claimed in claim 1 wherein, the elastic boundary is adapted to provide connection points along the perimeter edges.

11. A sail as claimed in claim l wherein, the at least three perimeter edges are shaped so as to optimize the ability of the membrane to form a minimal surface.

12. A sail as claimed in claim 1 wherein, the at least three edges are shaped so as to optimize the transfer of a load from the elastic boundary to the elastic membrane.

13. A sail as claimed in claim 1 wherein, the elastic boundary comprises an elastic cord.

14. A sail as claimed in claim 13 wherein, the elastic cord is moveably located along the at least three perimeter edges.

15. A sail as claimed in claim 13 wherein, the elastic cord is fixedly attached at the apexes of the at least three edges.

16. A sail as claimed in claim 13 wherein, the elastic cord is attached to the at least three edges.

17. A sail as claimed in claim 1 wherein, the elastic boundary comprises a silicone rubber compound.

* * * * *